United States Patent [19]

Daw

[11] Patent Number: 5,060,778

[45] Date of Patent: Oct. 29, 1991

[54] MOVING COIN VALIDATION

[75] Inventor: Ronald E. Daw, Wimbourne, England

[73] Assignee: Landis & Gyr Communications, England

[21] Appl. No.: 403,980

[22] Filed: Sep. 7, 1989

[30] Foreign Application Priority Data

Sep. 7, 1988 [GB] United Kingdom ..... 8821025

[51] Int. Cl.[5] ..... G07D 5/02; G07D 5/08

[52] U.S. Cl. ..... 194/317; 194/334

[58] Field of Search ..... 194/334, 317, 318, 319

[56] References Cited

U.S. PATENT DOCUMENTS

| | | | |
|---|---|---|---|
| 4,124,111 | 11/1978 | Hayashi | 194/334 |
| 4,462,513 | 7/1984 | Dean et al. | 194/318 |
| 4,601,380 | 7/1986 | Dean et al. | 194/318 |
| 4,660,705 | 4/1987 | Kai et al. | 194/334 X |
| 4,705,154 | 11/1987 | Masho et al. | 194/334 X |

*Primary Examiner*—F. J. Bartuska

*Attorney, Agent, or Firm*—Sughrue, Mion, Zinn, Macpeak & Seas

[57] ABSTRACT

A coin validation system includes a coin runway (1), a coil (2) positioned adjacent to the runway and a resonant circuit (4) coupled to the coil (2). A first signal monitoring circuit (6,8,12) is arranged to monitor oscillating signals generated in the resonant circuit (4) as the coin moves down the runway. The system further includes another coil (3). The other coil (3) is displaced with respect to the one coil (2) in the direction of movement of the coin (6) down the runway (1). Another resonant circuit (5) is coupled to the other coil (3) and a second signal monitoring circuit (7,8,11) are arranged to monitor the oscillating signals generated in the other resonant circuit (5). The signal monitoring circuits (6,7,8,11,12) are arranged to compare the signals in the resonant circuits (4,5) and to determine from a measured signal parameter a measurement which is representative of the coin (6) and which is velocity and acceleration independent.

9 Claims, 3 Drawing Sheets

MOVING COIN VALIDATION

The present invention relates to the validation of moving coins.

Coin validation apparatus is typically used in association with a coin freed mechanism or a coin receiving machine such as a coin box telephone or vending machine. Coin validation apparatus may also form part of a coin sorting device to check that the coins are valid and not counterfeit.

It is known to detect properties of a coin for the purposes of validation by measuring the effect of the coin on a coil in a tuned circuit In an earlier design by the present applicants the coin is brought to rest between two halves of a single tuned coil wound onto half cores of ferrite. The coin partially obscures the two half coils from each other. When it is positioned between the two half coils the coin increases the resonant frequency of the coil both by reduction of the coils' positive mutual inductance due to shielding and by the small resistance and inductance of the coin being reflected into the coil by transformer action. The magnitude of these effects depends principally upon the overlap area of the coin and the coil. The coin is stopped at a fixed reference point relative to the remainder of the validation apparatus and its overlap with the coil then depends on its diameter. By measuring the resonant frequency of the circuit the diameter of the coin is thus determined and may be compared with a reference value to validate the coin.

Static systems such as that described above suffer the disadvantage that it takes a relatively long period of time to validate each coin since each coin must be brought to rest, validated, and then urged in an appropriate direction depending on the results of the validation. In order to mitigate this disadvantage an arrangement described in EP-A-0203702 has been developed to carry out measurements on a moving coin. In this system a light beam detects the edge of a moving coin to initiate the measurement of the frequency of the resonant circuit. Since frequency takes a finite time to be measured the reading tends to be blurred by the movement of the coin. This is compensated for by averaging two measurements, one made with the coin moving into the coil and a second subsequent measurement made with the coin moving out of the coil. Averaging the two readings in this manner suffices to eliminate the effects of the coin's velocity, however if the coin accelerates during its movement through the coil then the change in velocity is not compensated for. Since in practice there is always some variation in the velocity of the coin this gives rise to an error which significantly limits the accuracy of the validation system.

According to the present invention a coin validation system comprising a coin runway, a coil positioned adjacent the runway, a resonant circuit coupled to the coil, and first signal monitoring means arranged to monitor oscillating signals generated in the resonant circuit as the coin moves down the runway, is characterised in that the system further includes another coil, the other coil being displaced with respect to the one in the direction of the movement of the coin down the runway, another resonant circuit coupled to the other coil and second signal monitoring means arranged to monitor oscillating signals generated in the other resonant circuit, the first and second signal monitoring means being arranged to compare the signals in the resonant circuits and to determine from a measured signal parameter a velocity and acceleration independent measurement representative of the coin.

Preferably the signal monitoring means include processor means arranged to record successive values of the frequencies of the signals in the two resonant circuits to derive relative frequency curves for the two coils and to determine the frequency at which the relative frequency curves intersect.

The present invention uses two spaced apart coils to provide an instantaneous velocity and acceleration independent measurement of a property of the coin being tested, such as its diameter. Each coil has its own associated resonant circuit including an oscillator which generates an oscillating signal By monitoring and comparing the signals in the two resonant circuits it is possible to determine how far out of the upstream coil the trailing edge of the coil is and how far into the downstream coil the leading edge of the coin is Since the separation of the coils is fixed and known it is then possible to compute a parameter dependent on the diameter of the coin for the purpose of validation.

A system in accordance with the present invention is now described in detail with reference to the accompanying drawings in which.

Figure 1:
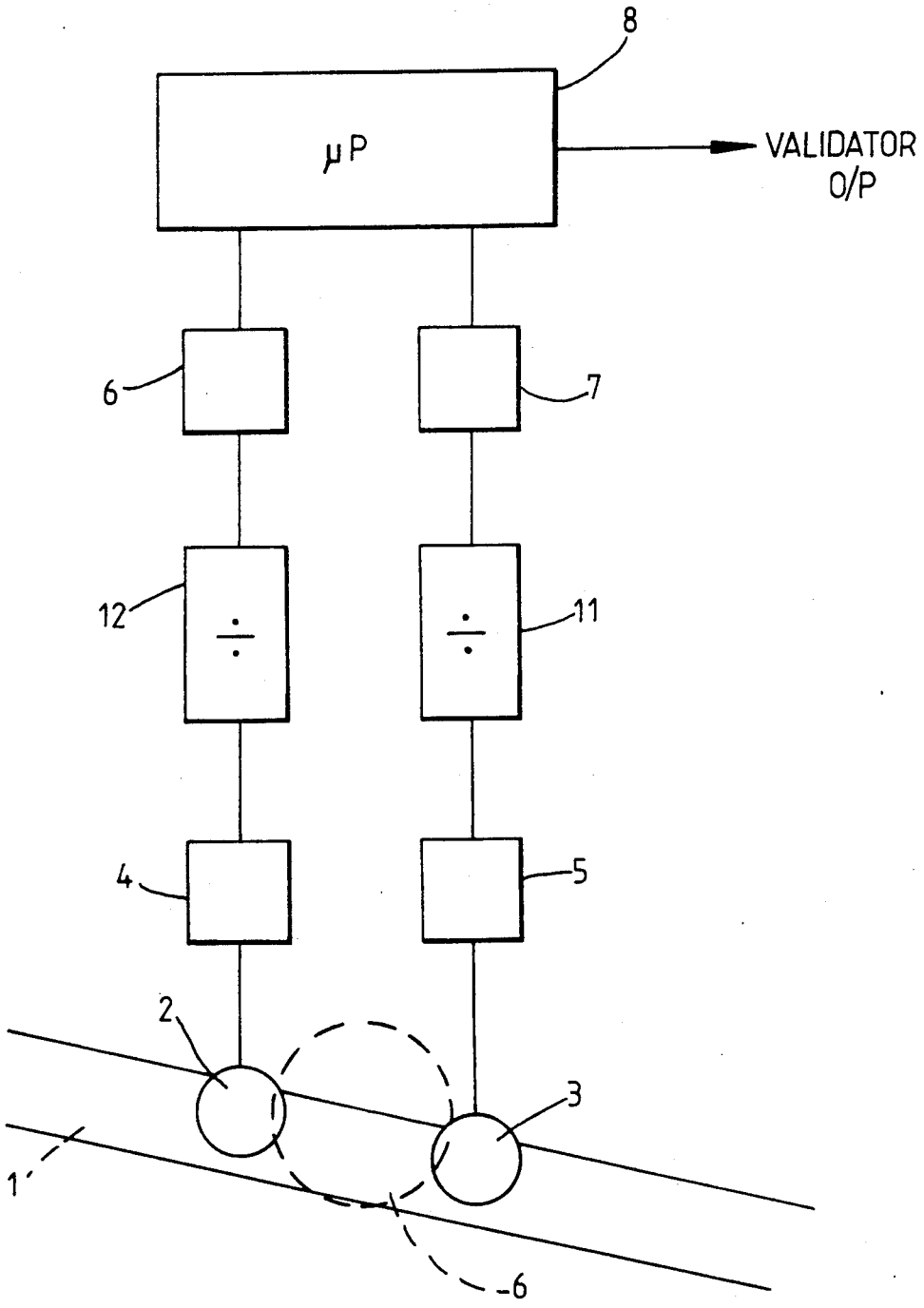
FIG. 1 is a block diagram of a coin validation system.

A coin validation system, which may be self contained or alternatively may be incorporated into a larger system such as a pay telephone, includes a coin runway 1 of conventional design In use a coin C is fed into the runway 1 from a slot at its upper end and runs down the runway. Typically at the lower end of the runway 1 there is provided a mechanism (not shown) which switches the coin C between one or other of two paths in response to an output signal from the validator.

Two coils 2,3 are positioned along the runway. Each coil comprises two half-coils, one on each side of the runway. In the present example the two half-coils are connected in series to each other and to a resonant circuit 4,5 including an oscillator which generates an oscillating signal. Other arrangements are possible in which the two half-coils are connected in parallel. Counters 6,7 connected to the resonant circuits 4,5 produce outputs dependent upon the frequency of the signal in each resonant circuit 4,5. The outputs of the counters 6,7 are fed to a microprocessor 8 which, in the manner described in further detail below, compares the signal to determine a parameter dependent on the diameter of the coin and compares the determined value with stored reference values. As a result of this comparison the coin is determined to be valid or invalid and the appropriate output signal produced.

Figure 3:
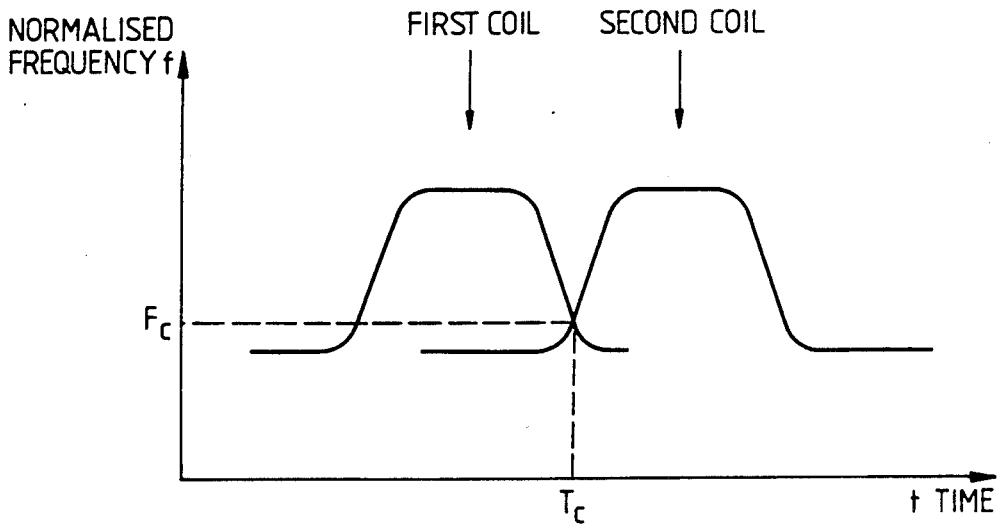
FIG. 3 is a graph showing normalised frequency curves for the two coils of FIG. 1.

As the coin C moves past each coil it changes the effective inductance of the coil and so shifts the resonant frequency of the circuit of which the coil forms a part. This effect and the construction of a suitable resonant circuit and oscillator are described in greater detail in EP-A-0203702. As the coin enters the upstream coil 2 the frequency of the oscillating signal in the associated resonant circuit rises, reaching a maximum when the coin is in the centre of the coil. Then as the coin moves further forward the frequency of the oscillating signal in this circuit drops. At the same time the coin moves into the downstream coil 3 and so the frequency in the resonant circuit 5 begins to rise. This effect is shown in FIG. 3 which is a plot of the normalised frequency of the resonant signal in each resonant circuit against time. At time $T_c$ the relative frequency curve for the first coil 2 which is falling from unity towards zero intersects the relative frequency curve for the second coil 3 which is rising from zero towards unity. At that time the coil is positioned with its centre exactly midway between the two coils and from the corresponding ordinate $F_c$ a parameter which scales with the diameter of the coin may be determined. At this point the derivatives of the two curves are equal and opposite.

The two coil cores are chosen to have similar dimensions and in the preferred example are formed on circular ferrite cores. The two coils and their associated circuits are tuned to different frequencies, in the preferred example 100KHz and 1 MHz. The use of two frequencies optimises the detection of non-homogeneous coins. The depth of penetration of the coin by the field from the coil varies with frequency. It is therefore possible by comparison of the response of the different coils at their different respective frequencies to distinguish between, e.g., plated and laminated coins. Dividing circuits are then provided between the output of each resonant circuit and the associated counter to divide down the output frequencies by the appropriate ratio. Thus in the present example the 100 KHz coil has its output divided by 10 and the 1 MHz coil has its output divided by 100. However even after division the frequency curves of the two coils will in general have different peak frequencies and different minimum frequencies. The microprocessor 8 is therefore arranged initially to shift the frequency curves to a common base line and to normalise the curves so that they have a common amplitude. The microprocessor 8 stores a number of readings, typically as many as 40 in a period of 250 microseconds as the coin passes the coils 2,3. From these numerous values the relative frequency curves and the point of intersection of these curves are determined. In this manner the crossover at time $T_c$ is computed from a large number of points and so any random errors in the measurements are eliminated. The microprocessor calculates from $F_c$ the displacement of the trailing edge of the coin from the centre of the upstream coil 2 and the distance of the leading edge of the coin from the downstream coil 3. Since the separation of the coils 2,3 is known it is then possible to calculate the diameter of the coin and to use this data for validation of the coin by comparing the calculated value with stored reference values. In practice the separation of the coils is chosen to be such that the smallest coin to be tested has sufficient diameter to overlap both coils and the largest coin to be tested is not so big that both coils are covered simultaneously. The separation of the coils may be determined precisely and the validator calibrated using tokens in the manner described in EP-B-072 189.

Figure 2:
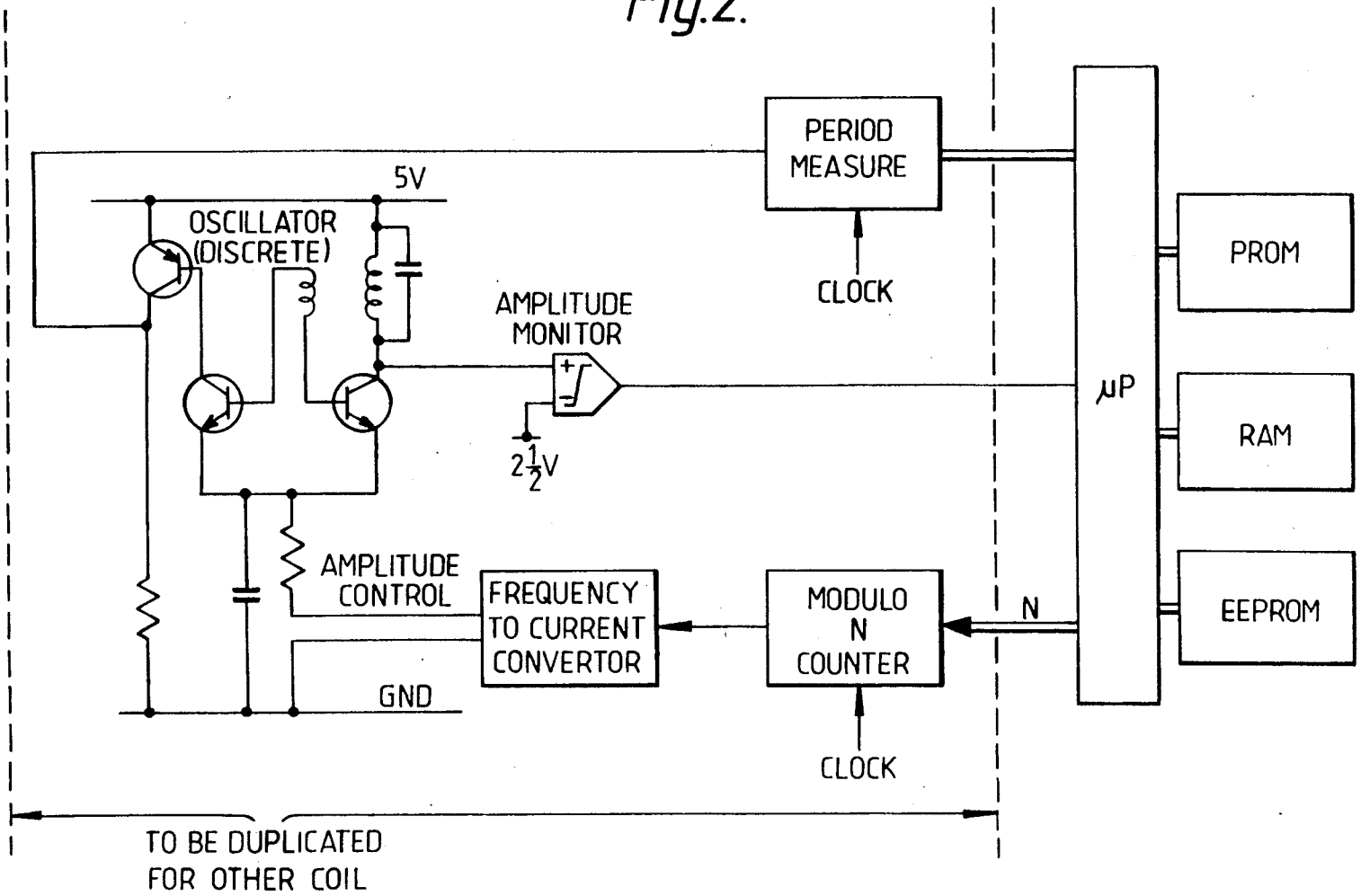
FIG. 2 is a circuit diagram showing a circuit suitable for use in the system of FIG. 1.

FIG. 2 shows the oscillator and counter circuits in greater detail. The amplitude of the oscillating signal in the oscillator circuit is monitored via an integrating amplitude monitor 9 and feedback used to drive the frequency of the oscillator so that it tracks the resonant frequency of the circuit as it shifts as a result of the presence of the coin. FIG. 2 shows the oscillator circuit for a single coil: in practice this is duplicated for the second coil.

I claim:

1. A coin validation system comprising a coin runway, a first coil positioned adjacent the runway, a first resonant circuit coupled to the first coil, and first signal monitoring means arranged to monitor oscillating signals generated in the resonant circuit as the coin moves down the runway, characterized in that the system further includes a second coil independent of the first coil, the second coil being displaced with respect to the first coil in the direction of the movement of the coin down the runway, a second resonant circuit independent of the first resonant circuit and coupled to the second coil and second signal monitoring means arranged to monitor oscillating signals generated in the second resonant circuit, said first and second coils, said first and second resonant circuits, and said first and second signal monitoring means all operating concurrently, the first and second signal monitoring means including means for comparing a signal in said first resonant circuit and a concurrent signal in said second resonant circuit and determining, from a measured signal parameter, a velocity and acceleration independent measurement representative of the coin.

2. A coin validation system according to claim 1, in which the signal monitoring means include processor means arranged to record successive values of the frequencies of the signals in the two resonant circuits to derive relative frequency curves for the two coils and to determine the frequency at which the relative frequency curves intersect.

3. A coin validation system according to claim 2, in which each coil comprises two half-coils, one on each side of the runway.

4. A coin validation system according to claim 3, in which the two half-coils of each coil are connected in series.

5. A coin validation system according to claim 1, in which the two coils have cores of similar dimension.

6. A coin validation system according to claim 1, in which the two coils and their associated circuits are tuned to different frequencies.

7. A coin validation system according to claim 6, in which the signal monitoring means are arranged to determine whether the coin is plated or laminated by comparison of the signals at the different frequencies.

8. A coin validation system according to claim 6 or 7, in which the different frequencies are substantially 100 KHz and 1 MHz.

9. A coin validation system according to claim 6, in which the outputs of ,the resonant circuits are divided in the ratio of their different respective frequencies.

* * * * *